US005427046A

United States Patent [19]

Brown et al.

[11] Patent Number: 5,427,046

[45] Date of Patent: Jun. 27, 1995

[54] SUBSEA CONDUIT STRUCTURE

[75] Inventors: Paul A. Brown, Nice; Leendert Poldervaart, La Turbie, both of France

[73] Assignee: Single Buoy Moorings Inc., Marly, Switzerland

[21] Appl. No.: 182,332

[22] Filed: Jan. 18, 1994

[51] Int. Cl.[6] ..... B63B 21/00

[52] U.S. Cl. ..... 114/230; 441/3

[58] Field of Search ..... 441/3-5; 114/230; 141/279, 387, 388

[56] References Cited

U.S. PATENT DOCUMENTS 3,103,020 9/1963 Bolton ..... 441/3 X
4,173,804 11/1979 Duc ..... 441/4
4,301,840 11/1981 Jansen ..... 141/387 X

FOREIGN PATENT DOCUMENTS 0063911 11/1982 European Pat. Off. .

*Primary Examiner*—Sherman Basinger
*Attorney, Agent, or Firm*—Young & Thompson

[57] ABSTRACT

A subsea conduit structure comprising a buoyant column and a conduit which is supported by the buoyant column. The buoyant column is connected to the seabed through an articulation provided near the seabed. The conduit comprises an upper catenary extending from the upper part of the buoyant column to a floating unit. The conduit also comprises a lower catenary extending from the buoyant column to a seabed connection in horizontal direction from the articulation of the buoyant column.

2 Claims, 1 Drawing Sheet

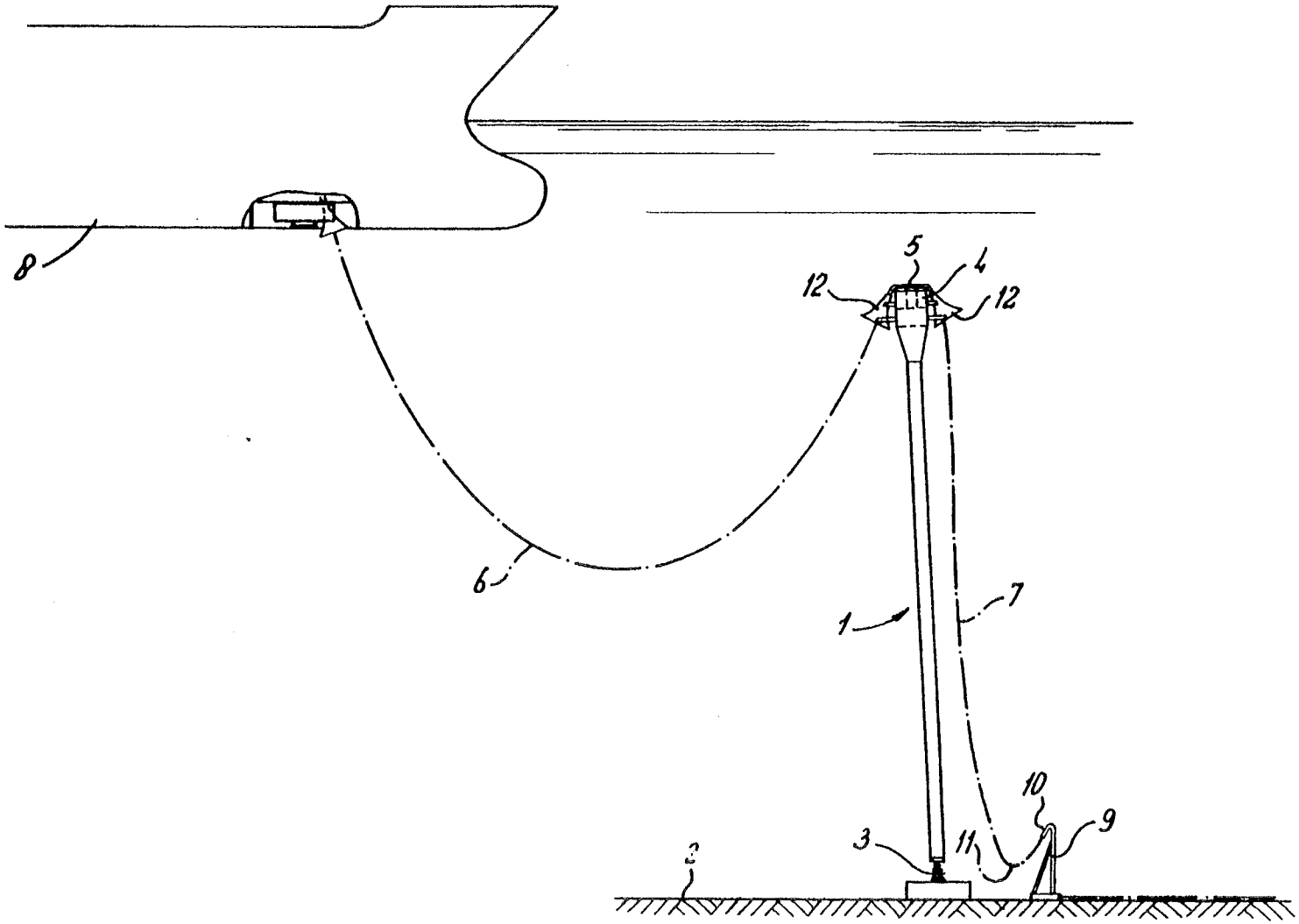
1
2
3
4
5
6
7
8
9
10
11
12
12

SUBSEA CONDUIT STRUCTURE

The subject invention relates to a subsea conduit structure for connection of a floating unit to a seabed structure. In relatively shallow waters and under harsh environmental conditions large horizontal displacement of the floating unit relative to the seabed is expected. During these adverse conditions the fluid transfer between the seabed connection and the floating unit must be able to compensate for such displacement to obviate frequent disconnection of the upper part of the conduit from the floating unit.

In the European patent application 0 063 911 a subsea conduit structure is shown comprising a rigid riser extending from the seabed at least halfway up the depth of the related sea and provided at its top with a connection for the flexible pipe which is connected to the floating unit through a sagging part. The riser comprises three parts each being rigid in itself and interconnected through articulated joints. The riser part adjacent to the sea bottom is also provided with an articulated joint. A flowline is rigidly supported along the rigid riser parts from the buoyancy element at the top of the rigid riser to the seabed. The disadvantage of such structure is that if high temperature production flowlines are required, thermal expansion causes unacceptable stress, since the flowlines are rigidly supported. The invention aims to simplify the structure of the buoyant column without restricting its scope of accommodation of displacements of the floating unit relative to the seabed. A prior art subsea conduit structure also exists wherein a flexible pipe is connected from a floating unit to a buoyancy element and then continues directly to the seabed connection at a near vertical angle. However, during a relatively large excursion flexible problems result near the seabed connection. A proposal has been to provide so called bend stiffeners which control the curvature of the flexible pipe near that seabed connection. However, these bend stiffeners cannot be designed for large angular deflections.

The invention aims to prevent the use of such bend stiffeners and retain to the use of relatively cheap and easy to install flexible pipes for the lower part of the conduit.

SUMMARY OF THE INVENTION

To realize one or more of the objects as described above the invention provides a subsea conduit structure comprising a support structure including a buoyant column connected to the seabed and having an articulated joint provided near the seabed the structure further having at its upper end conduit support means; and a conduit having an upper catenary extending from said conduit support means to a floating unit being spaced in horizontal direction from the conduit support means to a connection structure provided on the seabed, wherein said lower catenary comprises a flexible pipe, the seabed connection structure being spaced in horizontal direction from the articulation, wherein said lower catenary is supported freely from the conduit support means to said seabed connection structure.

According to a further aspect of the invention the seabed connection structure comprises a connection means for connection with the lower catenary vertically spaced from the seabed.

According to a further aspect of the invention the lower catenary is partly guided through guides fixed to the buoyant column.

According to a further aspect of the invention the length of the flexible pipe and the height of the connection means relative to the seabed are such that under operating conditions the lower part of the pipe will be spaced from the seabed.

To further simplify the structure of the buoyant column this preferably is a substantially rigid column.

According to a further preferred embodiment the conduit support means comprise at least one funnel-shaped member through which the conduit is introduced.

BRIEF DESCRIPTION OF THE DRAWING

The invention will be further elucidated referring to a preferred embodiment of the invention illustrated in the drawing diagrammatically showing the subsea conduit structure according to the invention.

DETAILED DESCRIPTION OF THE EMBODIMENT

In the drawing the buoyant column is referred to with 1. It comprises a simple rigid member connected to seabed 2 through an articulation 3. It has to be understood that the connection between the rigid member of the buoyant column and the seabed can include any swivel or articulating joint known in the art. On top of the rigid member a buoyancy element 4 is provided having at its top a conduit support 5. The conduit shown extends from the seabed 2 to a floating unit 8. The free extremity of upper catenary 6 of the conduit can be provided with buoyancy means and quick release means to be able to disconnect upper catenary 6 from floating unit 8 under adverse weather conditions. Transition from conduit 6 to conduit support 5 is realized by funnel 12 which guides flexible line 6 and prevents overstressing near conduit support 5. A same kind of funnel 12 is provided at the other side of conduit support 5 to guide lower catenary 7. This funnel may be placed at any position along the length of buoyancy column 1 wherein additional guides are required along the column. Lower catenary 7 extends to seabed support 9 which is provided with connection 10. Seabed support 9 is spaced from articulation 3 such that lower catenary or flexible pipe 7 will be spaced from the buoyant column. In relation to the height of the buoyant column 1 and the spacing of seabed support 9 the length of lower catenary 7 is chosen such that in the vertical position there will always be some sagging of lower catenary 7 of which the lowest point is referred to by 11. This allows for tilting of buoyant column 1. In operating conditions buoyant column 1 tilts in leftward direction without overstressing lower catenary 7. In addition buoyant column 1 may rotate in the right hand direction without lower part 11 touching the seabed. From connection 10 a pipe structure, not shown, extends over or into the seabed to any subsea well or the like. Through the structure shown it is possible to accommodate considerable displacements of the floating unit relative to the seabed connection 10 without undue wear and tear of the conduit. This is most important in shallow and medium water developments in harsh environmental conditions. On the other hand the use of a so called bend can be obviated which results in a considerable saving of costs. The flexible pipes used for both the upper and lower catenary are well proven items in mooring systems. Although the buoyant column is a single rigid column it can of course be assembled from several tubular parts which are interconnected through e.g. flanges. The conduits comprising upper catenary 6 and lower catenary 7 can be any flexible line known in the art but may also comprise rigid pipe portions interconnected by sealed ball articulations.

We claim:

1. A subsea conduit structure comprising a rigid column (1) connected to the seabed (2) by means of an articulation (3), said column having at the top a buoyancy element (4), a flexible conduit (6, 7) which extends from a seabed connection structure (9) towards a coupling with a floating unit (8) via a lower first catenary part (7) between the top of the column and a connection point (10) with the seabed structure spaced apart from the column (1) and the seabed (2), said flexible conduit having an upper second catenary part (6) between the top of the column and the floating unit (8), and means carried by the column for supporting the conduit, said support means comprising at least one funnel shaped guide element for the conduit.

2. A subsea conduit structure comprising a column (1) connected to the seabed (2) by means of an articulation (3), said column having at the top a buoyancy element (4), a flexible conduit (6, 7) which extends from a seabed connection structure (9) toward a coupling with a floating unit (8) via a lower first catenary part (7) between the top of the column and a connection point (10) with the seabed structure (9), said connection point (10) being spaced apart from the column (1), said flexible conduit having an upper second catenary part (6) between the top of the column and the floating unit (8), and means carried by the column for supporting the conduit.

* * * * *